US006544297B1

(12) United States Patent
Liu et al.

(10) Patent No.: US 6,544,297 B1
(45) **Date of Patent: *Apr. 8, 2003**

(54) SINGLE-BATH BIOPREPARATION AND DYEING OF TEXTILES

(75) Inventors: Jiyin Liu, Raleigh, NC (US); Brian Condon, Wake Forest, NC (US); Harry Lee Showmaker, III, Raleigh, NC (US)

(73) Assignee: Novozymes, A/S, Bagsvaerd (DK)

( * ) Notice: Subject to any disclaimer, the term of this patent is extended or adjusted under 35 U.S.C. 154(b) by 0 days.

This patent is subject to a terminal disclaimer.

(21) Appl. No.: 09/578,055

(22) Filed: May 24, 2000

Related U.S. Application Data

(63) Continuation-in-part of application No. 09/317,546, filed on May 24, 1999, now Pat. No. 6,162,260.

(51) Int. Cl.[7] ..... C09B 67/00; D06P 1/22; D06P 1/30; D06P 1/38; D06P 1/39

(52) U.S. Cl. ..... 8/401; 8/139; 8/111; 252/263; 252/264

(58) Field of Search ..... 235/263, 264; 8/139, 401, 111, 649, 650

(56) References Cited

U.S. PATENT DOCUMENTS 5,460,966 A 10/1995 Dixon

FOREIGN PATENT DOCUMENTS

| | | |
|---|---|---|
| DE | 750352 | 10/1953 |
| GB | 2 079 328 | 1/1982 |
| JP | 02216286 | 8/1990 |
| WO | WO 97/23684 | 7/1997 |
| WO | WO 98/24965 | 6/1998 |

*Primary Examiner*—Margaret Einsmann
(74) *Attorney, Agent, or Firm*—Jason I. Garbell; Elias J. Lambiris

(57) ABSTRACT

The present invention provides methods for single-bath biopreparation and dyeing of cellulosic fibers, which are carried out by contacting the fibers simultaneously or sequentially with a bioscouring enzyme, preferably pectinase, protease, and/or lipase, and a dyeing system, under conditions that do not require emptying the bath or rinsing the fabric between biopreparation and dyeing steps.

25 Claims, 2 Drawing Sheets

Wettability of Fabrics after Bioprepartion and Dyeing from Example 10

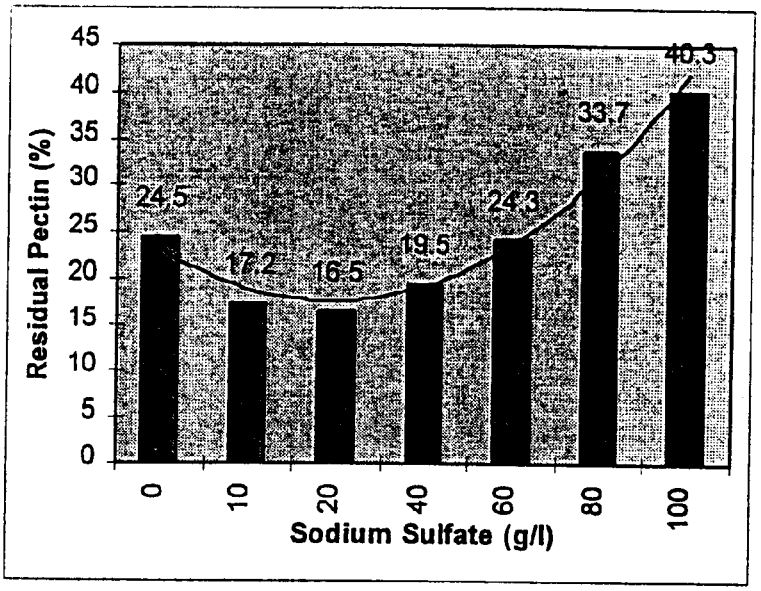
Fig. 1: The Impact of Sodium Sulfate on the Activity of Pectate Lyase

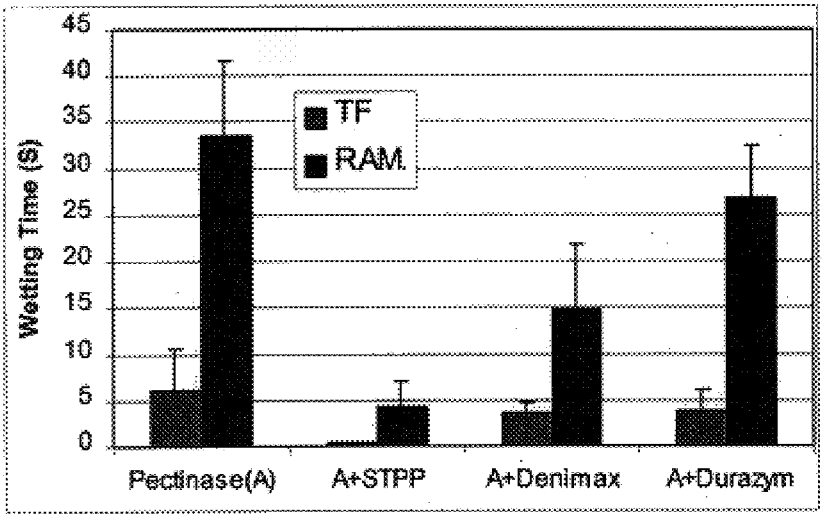
Figure 2: Wettability of Fabrics after Bioprepartion and Dyeing from Example 10

SINGLE-BATH BIOPREPARATION AND DYEING OF TEXTILES

This application is a continuation-in-part of application Ser. No. 09/317,546 filed on May 24, 1999 now U.S. Pat. No. 6,162,260, the contents of which are fully incorporated herein by reference.

FIELD OF THE INVENTION

The present invention relates to methods for treatment of cellulosic fibers, particularly textiles and most particularly cotton fabrics, to achieve scouring and dyeing using a single-bath method.

BACKGROUND OF THE INVENTION

The processing of cellulosic material such as cotton fiber into a material ready for garment manufacture involves several steps: spinning of the fiber into a yarn; construction of woven or knit fabric from the yarn; and subsequent preparation, dyeing and finishing operations. The preparation process, which may involve desizing (for woven goods), scouring, and bleaching, produces a textile suitable for dyeing.

A. Scouring: The scouring process removes much of the non-cellulosic compounds naturally found in cotton. In addition to the natural non-cellulosic impurities, scouring can remove residual manufacturing introduced materials such as spinning, coning or slashing lubricants. Conventional scouring processes typically utilize highly alkaline chemical treatment, which results not only in removal of impurities but also in weakening of the underlying cellulose component of the fiber or fabric. The chemical scouring is followed by extensive rinsing to reduce the risk of re-depositing impurities. Insufficient rinsing yields alkaline residue and uneven removal of impurities on the fabric, which in turn results in uneven dyeing in the subsequent process. Furthermore, chemical scouring creates environmental problems in effluent disposal, due to the chemicals employed and the materials extracted from the fibers. A superior method involves the use of enzymes, particularly pectinases, for scouring, as disclosed, e.g., in U.S. Pat. No. 5,912,407; Hartzell et al., *Textile Res.* 68:233 (1998); Hsieh et al., *Textile Res.* 69:590 (1999); Buchert et al., *Text. Chem. Col. & Am. Dyestuff Reptr.* 32:48 (2000); and Li et al., *Text. Chem. Color.* 29:71 (1997).

B. Dyeing: Dyeing of textiles is often considered to be the most important and expensive single step in the manufacturing of textile fabrics and garments. The major classes of dyes are azo (mono-, di-, tri-, etc.), carbonyl (anthraquinone and indigo derivatives), cyanine, di- and triphenylmethane and phthalocyanine. All these dyes contain chromophore groups, which give rise to color. These chemical structures constitute several cellulosic dye classes, i.e. vat, sulfur, azoic, direct, and reactive dyes as defined in the Colour Index. Three of these dye types involve an oxidation/reduction mechanism, i.e., vat, sulfur and azoic dyes. The purpose of the oxidation/reduction step in these dyeing procedures is to change the dyestuff between an insoluble and a soluble form.

Processing and dyeing procedures are performed in either a batch or continuous mode, with the fabric being contacted by the liquid processing stream in open width or rope form. In continuous methods, a saturator is used to apply chemicals to the fabric, after which the fabric is heated in a chamber where the chemical reaction takes place. A washing section then prepares the fabric for the next processing step.

Batch processing generally takes place in one processing bath whereby the fabric is circulated through the bath. After a reaction period, the chemicals are drained, fabric rinsed and the next chemical is applied. Discontinuous pad-batch processing involves a continuous application of processing chemical followed by a dwell period, which, in the case of cold pad-batch, might be one or more days.

Regardless of whether batch, continuous, or discontinuous pad-batch methods are used, scouring and dyeing steps have not heretofore been compatible; consequently, it has been necessary to rinse or otherwise treat the fabric or to replace the treating solutions between scouring and dyeing. Thus, there is a need in the art for harmonization of scouring and dyeing methods so that they can be performed in a single bath, whether simultaneously or sequentially, so as to shorten processing time, conserve materials, and reduce the waste stream.

SUMMARY OF THE INVENTION

The present invention provides methods for single-bath bioscouring and dyeing of cellulosic fibers. The methods are carried out by contacting the fibers with (i) a bioscouring enzyme, and (ii) a dyeing system; by adding the bioscouring enzyme and the dyeing system to the same solution that contacts the fibers. The bioscouring enzyme and the dyeing system may be added substantially simultaneously to the solution containing the fibers. Alternatively, the fibers are (i) contacted with the bioscouring enzyme, for a sufficient time and under appropriate conditions that result in effective bioscouring, after which (ii) the dyeing system is added directly to the solution containing the fibers and the bioscouring enzyme.

Bioscouring enzymes useful in practicing the present invention include, without limitation, pectinases, proteases, lipases, and combinations thereof.

The dyeing system may comprise one or more of direct, reactive, vat, sulfur, or azoic dyes. Alternatively, the dyeing system may comprise: (a) one or more mono- or polycyclic aromatic or heteroaromatic compounds, which function as dye precursors and/or as enhancers or mediators; and (b) (i) an enzyme exhibiting peroxidase activity and a hydrogen peroxide source or (ii) an enzyme exhibiting oxidase activity on the one or more mono- or polycyclic aromatic or heteroaromatic compounds.

Preferably, at least about 30% by weight of the pectin in the fibers is removed by the bioscouring enzyme; more preferably, at least about 50%, and most preferably, at least about 70%, is removed. Furthermore, using the methods of the invention, satisfactory uniformity of dyeing (as measured by visual examination) is achieved. Dyeing fastness properties such as washing fastness, light fastness and crocking (wet and dry) fastness are preferably at least about 3.0 on a color gray scale (Method EP1 in AATCC Technical Manual, vol. 7, 1995, p.350), more preferably above 3.5, and most preferably above 4.0.

In one embodiment, the fibers are contacted with 2000 APSU/kg fabric of pectate lyase at pH about 8, 55° C. for about 20 minutes, in the presence of both about 22 gram/l sodium salt and 2% on weight of good (% o.w.g.) of reactive dye in the solution. The color uptake of the fiber is further enhanced by raising the pH using sodium carbonate.

In another embodiment, the fibers are contacted with 2000 APSU/kg fabric of pectate lyase at pH about 8, 55° C. for about 30 minutes in the presence of about 22 gram/l sodium salt, about 0.02 g/l chelator (sodium tetraethylenediaminetetraacetate), and 2% o.w.g. of reactive dye. The dye uptake onto the fibers is enhanced by raising the pH using sodium carbonate.

In another embodiment, the fibers are contacted with 2000 APSU/kg fabric of pectate lyase in 2 mM borate buffer pH9, 55° C. for 20 minutes. Sodium salt and a reactive dye are added subsequently, after pH is lowered to about 7.5 or lower. The dyeing is then carried out at 60° C. for 30 minutes and dye uptake is enhanced by raising the pH of the solution using sodium carbonate.

In another other embodiment, the fibers may also be contacted with additional enzymes, including without limitation other pectin-degrading enzymes, proteases, lipases, and cellulases, alone or in combination with each other or with pectate lyase.

The methods of the invention can be used for treating crude fibers, yarn, or woven or knit textiles. The fibers may be cotton, linen, flax, ramie, rayon, hemp, jute, or blends of these fibers with each other or with other natural or synthetic fibers.

BRIEF DESCRIPTION OF THE DRAWINGS

FIG. 1 is a graphic illustration of the effect of increasing sodium sulfate concentrations on pectate lyase activity on woven cotton fabric.

FIG. 2 is a graphic illustration of the effect of single-bath biopreparation and dyeing on fabric wettability.

DETAILED DESCRIPTION OF THE INVENTION

The present invention is based on the discovery that preparation and dyeing of cellulosic fibers can be achieved in a single bath by using bioscouring enzymes in conjunction with a dyeing system. The methods of the invention are carried out by contacting the fibers with (i) a bioscouring enzyme under conditions that result in pectin removal; and (ii) a dyeing system. Surprisingly, in these methods, the products of the bioscouring process do not interfere with dyeing. The methods of the invention can be used for single-bath biopreparation and dyeing of textiles, to produce a textile having desirable properties such as a uniform color. The present invention provides advantages over conventional scouring and dyeing processes, including: (i) shorter processing times; (ii) conservation of water; and (iii) reduction in waste stream.

"Cellulosic fiber" as used herein refers without limitation to cotton, linen, flax, ramie, rayon, hemp, jute, and their blends. The fiber may comprise without limitation crude fiber, yarn, woven or knit textile or fabric, or a garment or finished product.

Bioscouring Enzymes

Pectinases: Any pectinolytic enzyme composition with the ability to degrade the pectin composition of plant cell walls may be used in practicing the present invention. Suitable pectinases include, without limitation, those of fungal or bacterial origin. Chemically or genetically modified pectinases are also encompassed. Preferably, the pectinases used in the invention are recombinantly produced and are mono-component enzymes.

Pectinases can be classified according to their preferential substrate, highly methyl-esterified pectin or low methyl-esterified pectin and polygalacturonic acid (pectate), and their reaction mechanism, beta-elimination or hydrolysis. Pectinases can be mainly endo-acting, cutting the polymer at random sites within the chain to give a mixture of oligomers, or they may be exo-acting, attacking from one end of the polymer and producing monomers or dimers. Several pectinase activities acting on the smooth regions of pectin are included in the classification of enzymes provided by Enzyme Nomenclature (1992), e.g., pectate lyase (EC 4.2.2.2), pectin lyase (EC 4.2.2.10), polygalacturonase (EC 3.2.1.15), exo-polygalacturonase (EC 3.2.1.67), exo-polygalacturonate-lyase (EC 4.2.2.9) and exo-poly-alpha-galacturonosidase (EC 3.2.1.82). In preferred embodiments, the methods of the invention utilize pectate lyases.

Pectate lyase enzymatic activity as used herein refers to catalysis of the random cleavage of -1,4-glycosidic linkages in pectic acid (also called polygalcturonic acid) by transelimination. Pectate lyases are also termed polygalacturonate lyases and poly(1,4-D-galacturonide) lyases. For purposes of the present invention, pectate lyase enzymatic activity is the activity determined by measuring the increase in absorbance at 235 nm of a 0.1% w/v solution of sodium polygalacturonate in 0.1M glycine buffer at pH 10. Enzyme activity is typically expressed as x mol/min, i.e., the amount of enzyme that catalyzes the formation of x mole product/min. An alternative assay measures the decrease in viscosity of a 5% w/v solution of sodium polygalacturonate in 0.1M glycine buffer at pH 10, as measured by vibration viscometry (APSU units).

It will be understood that any pectate lyase may be used in practicing the present invention. In some embodiments, the methods utilize an enzyme that exhibits maximal activity at temperatures above about 70° C. Pectate lyases may also exhibit maximal activity at pHs above about 8 and/or exhibit enzymatic activity in the absence of added divalent cations such as calcium ions.

Non-limiting examples of pectate lyases whose use is encompassed by the present invention include pectate lyases that have been cloned from different bacterial genera such as Erwinia, Pseudomonas, Klebsiella and Xanthomonas, as well as from *Bacillus subtilis* (Nasser et al. (1993) *FEBS Letts.* 335:319–326) and Bacillus sp. YA-14 (Kim et al. (1994) *Biosci. Biotech. Biochem.* 58:947–949). Purification of pectate lyases with maximum activity in the pH range of 8–10 produced by *Bacillus pumilus* (Dave and Vaughn (1971) *J. Bacteriol.* 108:166–174), *B. polymyxa* (Nagel and Vaughn (1961) *Arch. Biochem. Biophys.* 93:344–352), *B. stearothermophilus* (Karbassi and Vaughn (1980) *Can. J. Microbiol.* 26:377–384), Bacillus sp. (Hasegawa and Nagel (1966) *J. Food Sci.* 31:838–845) and Bacillus sp. RK9 (Kelly and Fogarty (1978) *Can. J. Microbiol.* 24:1164–1172) have also been described. Any of the above, as well as divalent cation-independent and/or thermostable pectate lyases, may be used in practicing the invention.

In preferred embodiments, the pectate lyase comprises the amino acid sequence of a pectate lyase disclosed in Heffron et al., (1995) *Mol. Plant-Microbe Interact.* 8: 331–334 and Henrissat et al., (1995) *Plant Physiol.* 107:963–976.

Proteases: Suitable proteases include those of animal, vegetable or microbial origin, preferably of microbial origin. The protease may be a serine protease or a metalloprotease, preferably an alkaline microbial protease or a trypsin-like protease. Examples of proteases include aminopeptidases, including prolyl aminopeptidase (3.4.11.5), X-pro aminopeptidase (3.4.11.9), bacterial leucyl aminopeptidase (3.4.11.10), thermophilic aminopeptidase (3.4.11.12), lysyl aminopeptidase (3.4.11.15), tryptophanyl aminopeptidase (3.4.11.17), and methionyl aminopeptidase (3.4.11.18); serine endopeptidases, including chymotrypsin (3.4.21.1), trypsin (3.4.21.4), cucumisin (3.4.21.25), brachyurin (3.4.21.32), cerevisin (3.4.21.48)and subtilisin (3.4.21.62); cysteine endopeptidases, including papain (3.4.22.2), ficain (3.4.22.3), chymopapain (3.4.22.6), asclepain (3.4.22.7), actinidain (3.4.22.14), caricain (3.4.22.30) and ananain (3.4.22.31); aspartic endopeptidases, including pepsin A (3.4.23.1), Aspergillopepsin I (3.4.23.18), Penicillopepsin (3.4.23.20) and Saccharopepsin (3.4.23.25); and metalloendopeptidases, including Bacillolysin (3.4.24.28).

Non-limiting examples of subtilisins include subtilisin BPN', subtilisin amylosacchariticus, subtilisin 168, subtilisin mesentericopeptidase, subtilisin Carlsberg, subtilisin DY, subtilisin 309, subtilisin 147, thermitase, aqualysin, Bacillus PB92 protease, proteinase K, protease TW7, and protease TW3.

Commercially available proteases include Alcalase™, Savinase™, Primase™, Duralase™, Esperase™, Kannase™, and Durazym™ (Novo Nordisk A/S), Maxatase™, Maxacal™, Maxapem™, Properase™, Purafect™, Purafect OxP™, FN2™, and FN3™ (Genencor International Inc.).

Also useful in the present invention are protease variants, such as those disclosed in EP 130.756 (Genentech), EP 214.435 (Henkel), WO 87/04461 (Amgen), WO 87/05050 (Genex), EP 251.446 (Genencor), EP 260.105 (Genencor), Thomas et al., (1985), Nature. 318, p. 375–376, Thomas et al., (1987), J. Mol. Biol., 193, pp. 803–813, Russel et al., (1987), Nature, 328, p. 496–500, WO 88/08028 (Genex), WO 88/08033 (Amgen), WO 89/06279 (Novo Nordisk A/S), WO 91/00345 (Novo Nordisk A/S), EP 525 610 (Solvay) and WO 94/02618 (Gist-Brocades N.V.).

The activity of proteases can be determined as described in "Methods of Enzymatic Analysis", third edition, 1984, Verlag Chemie, Weinheim, vol. 5.

Lipases: Suitable lipases (also termed carboxylic ester hydrolases) include, without limitation, those of bacterial or fungal origin, including triacylglycerol lipases (3.1.1.3) and Phospholipase $A_2$(3.1.1.4.). Lipases for use in the present invention include, without limitation, lipases from Humicola (synonym Thermomyces), such as from *H. lanuginosa* (*T. lanuginosus*) as described in EP 258 068 and EP 305 216 or from *H. insolens* as described in WO 96/13580; a Pseudomonas lipase, such as from *P. alcaligenes* or *P. pseudoalcaligenes* (EP 218 272), *P. cepacia* (EP 331 376), *P. stutzeri* (GB 1,372,034), *P. fluorescens,* Pseudomonas sp. strain SD 705 (WO 95/06720 and WO 96/27002), *P. wisconsinensis* (WO 96/12012); a Bacillus lipase, such as from *B. subtilis* (Dartois et al., *Biochem. Biophys. Acta,* 1131:253–360, 1993); *B. stearothermophilus* (JP 64/744992) or *B. pumilus* (WO 91/16422). Other examples are lipase variants such as those described in WO 92/05249, WO 94/01541, EP 407 225, EP 260 105, WO 95/35381, WO 96/00292, WO 95/30744, WO 94/25578, WO 95/14783, WO 95/22615, WO 97/04079 and WO 97/07202. Preferred commercially available lipase enzymes include Lipolase™ and Lipolase Ultra™, Lipozyme™, Palatase™, Novozym™435, and Lecitase™ (all available from Novo Nordisk A/S). The activity of the lipase can be determined as described in "Methods of Enzymatic Analysis", Third Edition, 1984, Verlag Chemie, Weinhein, vol. 4.

It will be understood that any enzyme exhibiting bioscouring activity may be used in practicing the invention. That is, bioscouring enzymes derived from other organisms, or bioscouring enzymes derived from the enzymes listed above in which one or more amino acids have been added, deleted, or substituted, including hybrid polypeptides, may be used, so long as the resulting polypeptides exhibit bioscouring activity. Such variants useful in practicing the present invention can be created using conventional mutagenesis procedures and identified using, e.g., high-throughput screening techniques such as the agar plate screening procedure. For example, pectate lyase activity may be measured by applying a test solution to 4 mm holes punched out in agar plates (such as, for example, LB agar), containing 0.7% w/v sodium polygalacturonate (Sigma P 1879). The plates are then incubated for 6 h at a particular temperature (such as, e.g., 75° C.). The plates are then soaked in either (i) 1M $CaCl_2$ for 0.5 h or (ii) 1% mixed alkyl trimethylammonium Br (MTAB, Sigma M-7635) for 1 h. Both of these procedures cause the precipitation of polygalacturonate within the agar. Pectate lyase activity can be detected by the appearance of clear zones within a background of precipitated polygalacturonate. Sensitivity of the assay is calibrated using dilutions of a standard preparation of pectate lyase.

Determination of temperature, pH, and divalent cation dependence of an isolated bioscouring enzyme be achieved using conventional methods. For example, an enzymatic activity assay may be performed at a range of temperatures and pHs and in the presence and absence of different concentrations of $Ca^{++}$, and the temperature and pH optima and divalent cation effect (if any) are quantified. Temperature, pH, and cation dependence are then determined to establish the suitability of a particular pectate lyase for use in the present invention.

Bioscouring enzymes for use in the invention may be derived from their cell of origin or may be recombinantly produced, and may be purified or isolated. As used herein, a "purified" or "isolated" enzyme is one that has been treated to remove non-enzyme material derived from the cell in which it was synthesized that could interfere with its enzymatic activity. Typically, the bioscouring enzyme is separated from the bacterial or fungal microorganism in which it is produced as an endogenous constituent or as a recombinant product. If the enzyme is secreted into the culture medium, purification may comprise separating the culture medium from the biomass by centrifugation, filtration, or precipitation, using conventional methods. Alternatively, the enzyme may be released from the host cell by cell disruption and separation of the biomass. In some cases, further purification may be achieved by conventional protein purification methods, including without limitation ammonium sulfate precipitation; acid or chaotrope extraction; ion-exchange, molecular sieve, and hydrophobic chromatography, including FPLC and HPLC; preparative isoelectric focusing; and preparative polyacrylamide gel electrophoresis. Alternatively, purification may be achieved using affinity chromatography, including immunoaffinity chromatography. For example, hybrid recombinant pectate lyases may be used having an additional amino acid sequence that serves as an affinity "tag", which facilitates purification using an appropriate solid-phase matrix.

The bioscouring enzyme used in the methods of the invention may be chemically modified to enhance one or more properties that render them even more advantageous, such as, e.g., increasing solubility, decreasing lability or divalent ion dependence, etc. The modifications include, without limitation, phosphorylation, acetylation, sulfation, acylation, or other protein modifications known to those skilled in the art.

Dyeing Systems

In practicing the present invention, any dyeing system may be used that is compatible with (i) the conditions used for bioscouring, if bioscouring and dyeing are performed simultaneously, or (ii) the conditions as adjusted subsequent to bioscouring, if dyeing is performed after bioscouring. Such dyeing systems include, without limitation:

(a) Conventional dyeing systems, comprising one or more of direct dyes, such as, C. I. Direct Red 81, Yellow 11 and 28, Orange 39, Red 76, Blue 78, 86, 106, 107 and 108, Black 22; reactive dyes, such as, e.g., C. I. Reactive Red 1, 3, 6, 17, 120, 194, Blue 4, 19, 171 and 182, Black 5, Violet 5; vat dyes, such as, e.g., C. I. Vat Yellow 28, Orange 11 and 15, Blue 6, 16 and 20, Green 1 and 3, 8, Brown 1, Black 9, 27, sulfur dyes, such as, e.g., C. I. Sulfur Black 1 and 11, Brown 1, Red 10; and azoic dyes, such as, e.g., C. I. Coupling Components 5 and 13 in combination with C. I. Azoic Diazo Components 44 and 45. Such dyes are well known in the art and are described, e.g., in Shore, ed., *Cellulosic Dyeing,* Society of Dyers and Colorists, Alden Press, 1995; and in Colour Index, Society of Dyers and Colorists and American Association of Textile Chemists and Colorists, Vols. 1–8 Supplements, 1977–1988.

(b) Dyeing systems that utilize one or more oxidative enzymes. In enzymatic dyeing systems, one or more mono- or polycyclic aromatic or heteroaromatic compounds are oxidized by (a) a hydrogen peroxide source and an enzyme exhibiting peroxidase activity or (b) an enzyme exhibiting oxidase activity on the one or more mono- or polycyclic aromatic or heteroaromatic compounds, e.g., phenols and related substances. Enzymes exhibiting peroxidase activity include, but are not limited to, peroxidase (EC 1.11.1.7) and haloperoxidase, e.g., chloro-(EC 1.11.1.10), bromo-(EC 1.11.1) and iodoperoxidase (EC 1.11.1.8). Enzymes exhibiting oxidase activity include, but are not limited to, bilirubin oxidase (EC 1.3.3.5), catechol oxidase (EC 1.10.3.1), laccase (EC 1.10.3.2), o-aminophenol oxidase (EC 1.10.3.4), and polyphenol oxidase (EC 1.10.3.2). Assays for determining the activity of these enzymes are well known to persons of ordinary skill in the art. In preferred embodiments, the oxidative enzyme is a laccase.

Preferably, the enzyme is a laccase obtained from a genus selected from the group consisting of Aspergillus, Botrytis, Collybia, Fomes, Lentinus, Myceliophthora, Neurospora, Pleurotus, Podospora, Polyporus, Scytalidium, Trametes, and Rhizoctonia. In a more preferred embodiment, the laccase is obtained from a species selected from the group consisting of *Humicola brevis* var. *thermoidea, Humicola brevispora, Humicola grisea* var. *thermoidea, Humicola insolens,* and *Humicola lanuginosa* (also known as *Thermomyces lanuginosus*), *Myceliophthora thermophila, Myceliophthora vellerea, Polyporus pinsitus, Scytalidium thermophila, Scytalidium indonesiacum,* and *Torula thermophila.* The laccase may be obtained from other species of Scytalidium, such as *Scytalidium acidophilum, Scytalidium album, Scytalidium aurantiacum, Scytalidium circinatum, Scytalidium flaveobrunneum, Scytalidium hyalinum, Scytalidium lignicola,* and *Scytalidium uredinicolum. Rhizoctonia solani* and *Coprinus cinereus.* The laccase may be obtained from other species of Polyporus, such as *Polyporus zonatus, Polyporus alveolaris, Polyporus arcularius, Polyporus australiensis, Polyporus badius, Polyporus biformis, Polyporus brumalis, Polyporus ciliatus, Polyporus colensoi, Polyporus eucalyptorum, Polyporus meridionalis, Polyporus varius, Polyporus palustris, Polyporus rhizophilus, Polyporus rugulosus, Polyporus squamosus, Polyporus tuberaster,* and *Polyporus tumulosus.* The laccase may also be a modified laccase by at least one amino acid residue in a Type I (T1) copper site, wherein the modified oxidase possesses an altered pH and/or specific activity relative to the wild-type oxidase. For example, the modified laccase could be modified in segment (a) of the T1 copper site.

Peroxidases employed for the present purpose may be isolated from and are producible by plants (e.g., horseradish peroxidase) or microorganisms such as fungi or bacteria. Some preferred fungi include strains belonging to the subdivision Deuteromycotina, class Hyphomycetes, e.g., Fusarium, Humicola, Tricoderma, Myrothecium, Verticillum, Arthromyces, Caldariomyces, Ulocladium, Embellisia, Cladosporium or Dreschlera, in particular *Fusarium oxysporum* (DSM 2672), *Humicola insolens, Trichoderma resii, Myrothecium verrucana* (IFO 6113), *Verticillum alboatrum, Verticillum dahlie, Arthromyces ramosus* (FERM P-7754), *Caldariomyces fumago, Ulocladium chartarum, Embellisia alli* or *Dreschlera halodes.*

Other preferred fungi include strains belonging to the subdivision Basidiomycotina, class Basidiomycetes, e.g., Coprinus, Phanerochaete, Coriolus or Trametes, in particular *Coprinus cinereus* f. *microsporus* (IFO 8371), *Coprinus macrorhizus, Phanerochaete chrysosporium* (e.g., NA-12) or *Coriolus versicolor* (e.g., PR4 28-A). Further preferred fungi include strains belonging to the subdivision Zygomycotina, class Mycoraceae, e.g., Rhizopus or Mucor, in particular *Mucor hiemalis.*

Some preferred bacteria include strains of the order Actinomycetales, e.g., *Streptomyces spheroides* (ATTC 23965), *Streptomyces thermoviolaceus* (IFO 12382) or *Streptoverticillum verticillium* ssp. verticillium. Other preferred bacteria include *Bacillus pumillus* (ATCC 12905), *Bacillus stearothermophilus, Rhodobacter sphaeroides, Rhodomonas palustri, Streptococcus lactis, Pseudomonas purrocinia* (ATCC 15958) or *Pseudomonas fluorescens* (NRRL B-11).

Mono- or polycyclic aromatic or heteroaromatic compounds that can be used in conjunction with these oxidative enzymes include, without limitation, those that are substituted with one or more of $C_{1-6}$-alkoxy; $C_{1-6}$-alkyl; halogen; sulfo; sulfamino; nitro; azo; carboxy; amido; cyano; formyl; hydroxy; $C_{1-6}$-alkenyl; halocarbonyl; $C_{1-6}$-oxycarbonyl; carbamoyl; $C_{1-6}$-oxoalkyl; carbamidoyl; $C_{1-6}$-alkyl sulfanyl; sulfanyl; $C_{1-6}$-alkyl sulfonyl; phosphonato; phosphonyl; or amino which is optionally substituted with one, two or three $C_{1-6}$-alkyl groups. A polycyclic compound for purposes of the present invention has 2, 3 or 4 aromatic rings. Examples of such mono- or polycyclic aromatic or heteroaromatic compounds include, but are not limited to acridine, anthracene, benzene, benzofurane, benzothiazole, benzothiazoline, carboline, carbazole, chinoline, chromene, furan, imidazole, indazole, indene, indole, naphtalene, naphthylene, naphthylpyridine, phenanthrene, pyran, pyridazine, pyridazone, pyridine, pyrimidine, pyrrole, quinazoline, quinoline, quinoxaline, sulfonyl, thiophene, and triazine, each of which are optionally substituted. Examples of such compounds include, but are not limited to aromatic diamines, aminophenols, phenols and naphthols.

Methods for Single-bath Biopreparation and Dyeing

According to the present invention, biopreparation (or scouring) and dyeing are achieved in a single bath. There are at least two modes of practicing the invention. In Mode A, a bioscouring enzyme and a dyeing system are added to the aqueous solution or wash liquor which contacts the cellulosic fiber or fabric, and incubation is performed for sufficient time and under appropriate conditions to achieve both effective scouring and effective dyeing. In Mode B, (i) a bioscouring enzyme is added to the wash liquor; (ii) a first incubation is performed for sufficient time and under appropriate conditions to at least initiate, and preferably to achieve, effective scouring; (iii) the wash liquor containing the bioscouring enzyme is then supplemented with a dyeing system; and (iv) a second incubation is performed for a sufficient time and under appropriate conditions to achieve effective dyeing. It will be understood that the method of Mode B may further comprise adjusting one or more properties of the composition of the wash liquor between steps (ii) and (iii) (such as, e.g., pH, ionic strength, concentration or wetting agent, or concentration of divalent cationic chelator such as ethylene diamine tetraacetate), and that the conditions of the first and second incubations may also differ with respect to temperature, agitation, pH, time, and the like.

In one series of embodiments, the concentration of enzyme in the aqueous solution is adjusted so that the dosage of enzyme added to a given amount of fiber is between about 0.1 and about 10,000 mol/min/kg fiber, preferably between about 1 and about 2,000 mol/min/kg fiber, and most preferably between about 10 and about 500 mol/min/kg fiber. In another series of embodiments, the dosage of enzyme is between about 250 and 12,000 APSU/kg fiber, preferably between about 500 and 9000 APSU/kg fiber, and most preferably between about 1000 and 6000 APSU/kg fiber.

The aqueous solution containing the bioscouring enzyme has a pH of between about 4 and about 11. The preferred pH will depend on whether scouring and dyeing are performed simultaneously (Mode A) or sequentially (Mode B). In Mode A, the wash liquor preferably has a pH of between about 5 and about 8.5, and most preferably between about 7 and about 8. In Mode B, the wash liquor in steps (i) and (ii) preferably has a pH between about 8 and about 11, most preferably between about 8.5 and about 9.5, and in steps (iii) and (iv) between about 6 and about 11. Furthermore, the wash liquor preferably either contains a low concentration of added calcium, i.e., less than 2 mM $Ca^{++}$, or lacks added $Ca^{++}$ entirely.

In Mode A, the temperature at which the combined scouring and dyeing processes are carried out may be between about 25° C. and about 100° C., preferably fly between about 35° C. and about 90° C., and most preferably between about 45° C. and about 80° C. In Mode B, the temperature at which the scouring is carried out may be between about 25° C. and about 100° C., preferably between about 35° C. and about 75° C., and most preferably between about 45° C. and about 65° C.; and the temperature at which the subsequent dyeing is carried out may be between about 30° C. and about 100° C., preferably between about 50° C. and about 100° C., and most preferably between about 60° C. and about 90° C. It will be understood that the choice of temperature(s) will depend on (i) the nature of the fiber, i.e., crude fiber, yarn, or textile; (ii) the particular enzyme used for scouring, as well as the particular oxidative enzyme if used for dyeing, and (iii) the particular dye or dye type.

Effective scouring typically results in a wettability of less than about 10 seconds, preferably less than about 5 seconds, and most preferably less than about 2 seconds, when measured using the drop test according to AATCC Test Method 39-1980. Typically, effective scouring according to the invention requires the digestion of a substantial proportion of the pectin in the fiber, preferably at least 30% by weight, more preferably at least 50% by weight, and most preferably at least 70%. Pectin digestion refers to cleavage of -1,4-glycosidic linkages in pectin so that the digestion products can be removed from the fiber by, e.g., rinsing or any other conventional separation method. Methods for measuring the degree of pectin digestion of a fiber include, without limitation, the Ruthenium Red staining method as described by Luft, *The Anatomical Record* 171:347, 1971.

Effective dyeing typically results in one or more of the following properties: (i) a desired color shade and depth (as determined by L*a*b* measurements using, e.g., a Mecbeth color eye); (ii) a satisfactory uniformity of dyeing (assessed by visual examination); and (iii) dyeing fastness properties such as washing fastness, light fastness and crocking (wet and dry) fastness of least about 3.0, preferably above 3.5, and most preferably above 4.0 (as measured on a color gray scale using Method EP1 as disclosed in AATCC Technical Manual, vol. 7, 1995, p.350).

Furthermore, the methods of the invention may result in enhanced uptake of dye in fibers subjected to single-vat bioscouring and dyeing relative to fibers subjected only to dyeing; preferably, the enhancement of dye uptake is at least about 10%. Dye uptake may be measured by (i) measuring exhaustion of a dye solution or (ii) measuring the intensity of color in the fabric (L*a*b* value).

To achieve effective scouring, the dosage of enzyme(s) (mol/min/kg fiber), the concentration of enzyme(s) in the wash liquor (mol/min/L wash liquor), and the total volume of wash liquor applied to a given amount of fiber (L/kg fiber) will vary, depending on:

(i) the nature of the fiber, i.e., crude fiber, yarn, or textile;

(ii) whether simultaneous or sequential scouring and dyeing are carried out;

(iii) the particular enzyme(s) used, and the specific activity of the enzyme;

(iv) the conditions of temperature, pH, time, etc., at which the processing occurs;

(v) the presence of other components in the wash liquor; and (vi) the type of processing regime used, i.e., continuous, discontinuous pad-batch, or batch.

Determination of suitable conditions, including, e.g., enzyme dosage, enzyme concentration, volume of solution, and temperature to be used can be achieved using only routine experimentation by establishing a matrix of conditions and testing different points in the matrix. For example, the amount of enzyme, the temperature at which the contacting occurs, and the total time of processing can be varied, after which the resulting fiber or textile is evaluated for (a) pectin removal; (b) a scoured property such as, e.g., wettability; and (c) quality of dyeing.

In preferred embodiments of Mode A, the fiber is contacted with pectate lyase and a cellulosic dye such as C.I. Reactive Blue 184 under the following conditions: (i) a temperature of about 55° C.; (ii) a pH of about 7.0–10.5; (iii) the absence of added divalent cations; (iv) a wash liquor:fabric ratio of between about 0.5 and about 50; and (v) a bioscouring enzyme dosage of between about 10 and about 500 mol/min/kg fiber.

The manner in which the aqueous solution containing the enzyme is contacted with the cellulosic material will depend upon whether the processing regime is continuous, discontinuous pad-batch or batch. For continuous or discontinuous pad-batch processing, the aqueous enzyme solution is contained in a saturator bath and is applied continuously to the fabric as it travels through the bath, during which process the fabric typically absorbs the processing liquor at an amount of 0.5–1.5 times its weight. In batch operations, the fabric is exposed to the enzyme solution for a period ranging from about 5 minutes to 24 hours at a liquor-to-fabric ratio of 5:1–50:1.

Additional Components

In some embodiments of the invention, the aqueous solution or wash liquor further comprises other components, including without limitation other enzymes, as well as surfactants, bleaching agents, antifoaming agents, lubricants, builder systems, and the like, that enhance the scouring and/or dyeing processes and/or provide superior effects related to, e.g., strength, resistance to pilling, water absorbency, and dyeability.

Enzymes suitable for use in the present invention include without limitation pectinases, proteases, and lipases as described above; and cellulases. Cellulases are classified in a series of enzyme families encompassing endo- and exo-activities as well as cellobiose hydrolyzing capability. The cellulase used in practicing the present invention may be derived from microorganisms which are known to be capable of producing cellulolytic enzymes, such as, e.g., species of Humicola, Thermomyces, Bacillus, Trichoderma, Fusarium, Myceliophthora, Phanerochaete, Irpex, Scytalidium, Schizophyllum, Penicillium, Aspergillus, or Geotricum, particularly *Humicola insolens, Fusarium oxysporum,* or *Trichoderma reesei.* Non-limiting examples of suitable cellulases are disclosed in U.S. Pat. No. 4,435,307; European patent application No. 0 495 257; PCT Patent Application No. WO91/17244; and European Patent Application No. EP-A2-271 004.

The enzymes may be isolated from their cell of origin or may be recombinantly produced, and may be chemically or genetically modified. Typically, the enzymes are incorporated in the aqueous solution at a level of from about 0.0001% to about 1% of enzyme protein by weight of the composition, more preferably from about 0.001% to about 0.5% and most preferably from 0.01% to 0.2%. It will be understood that the amount of enzymatic activity units for each additional enzyme to be used in the methods of the present invention in conjunction with a particular bioscouring enzyme can be easily determined using conventional assays.

Surfactants suitable for use in practicing the present invention include, without limitation, nonionic (U.S. Pat. No. 4,565,647); anionic; cationic; and zwitterionic surfactants (U.S. Pat. No. 3,929,678); which are typically present at a concentration of between about 0.2% to about 15% by weight, preferably from about 1% to about 10% by weight. Anionic surfactants include, without limitation, linear alkylbenzenesulfonate, -olefinsulfonate, alkyl sulfate (fatty alcohol sulfate), alcohol ethoxysulfate, secondary alkanesulfonate, alpha-sulfo fatty acid methyl ester, alkyl- or alkenylsuccinic acid, and soap. Non-ionic surfactants include, without limitation, alcohol ethoxylate, nonylphenol ethoxylate, alkylpolyglycoside, alkyldimethylamineoxide, ethoxylated fatty acid monoethanolamide, fatty acid monoethanolamide, polyhydroxy alkyl fatty acid amide, and N-acyl N-alkyl derivatives of glucosamine ("glucamides").

Builder systems include, without limitation, aluminosilicates, silicates, polycarboxylates and fatty acids, materials such as ethylenediamine tetraacetate, and metal ion sequestrants such as aminopolyphosphonates, particularly ethylenediamine tetramethylene phosphonic acid and diethylene triamine pentamethylenephosphonic acid, which are included at a concentration of between about 5% to 80% by weight, preferably between about 5% and about 30% by weight.

Antifoam agents include without limitation silicones (U.S. Pat. No. 3,933,672; DC-544 (Dow Corning), which are typically included at a concentration of between about 0.01% and about 1% by weight.

The compositions may also contain soil-suspending agents, soil-releasing agents, optical brighteners, abrasives, and/or bactericides, as are conventionally known in the art.

The following are intended as non-limiting illustrations of the present invention.

EXAMPLE 1

Dyeing in the Absence of Bioscouring

A. Pretreatment: A 6 m×38 cm fabric tube weighing about 900 gram was constructed using an interlock knit fabric (type 4600, Ramseur Co., NC). The fabric tube was loaded into a jet dyer (Mathis Jet type JFO, Werner Mathis USA, Inc, North Carolina), which was then filled with 9.0 liters of a solution containing 0.5 g/l wetting agent (Basophen M, BASF) and 0.75 g/1 lubricant (Multiplus NB 100, BASF). The fabric was treated at 50° C. for 10 minutes, after which the water was drained.

B. Dyeing: 9.0 liters of cold solution containing 0.5 g/l Multiplus NB 100 and 22 g/l sodium sulfate (from Fisher) were added in the jet. The jet temperature was raised at 4° F./minute to 55° C. 2% on weight of good (% o.w.g., i.e. % owf) Reactive Navy FG (from Melatex Inc., Charlotte, N.C.) was added over 5 minutes at 55° C., and the fabric was continuously circulated for an additional 15 minutes. Dissolved sodium bicarbonate was then added to the bath to a final concentration of 0.5 g/l over 15 minutes, after which carbonate was added to the bath to a final concentration of 5.85 g/l over 15 minutes. After circulating at 55° C. for 30 minutes, the water was drained.

C. Post-treatment: The fabric tube was first rinsed until the wastewater was clear (approximately 15 minutes). 9 liters of hot water were then added and heated to 90° C. and kept for 10 minutes to remove surface dye. The fabric tube was rinsed until wastewater was clear (approximately 10 minutes). The fabric was then removed from the jet and water was extracted. The fabric tube was then dried in a Rhucke dryer at 149° C. (300° F.).

D. Analysis: The lightness/darkness, streaking, and shade of the dyed fabric were rated by a panel of three or more people. The L*a*b* of colored fabric was measured with a Macbeth color eye. The fabric was judged to be at an industrial satisfactory level with blue shade. The results are presented in Table 1 below.

EXAMPLE 2

Simultaneous One-Bath Scouring and Dyeing

The same fabric and equipment were used as in Example 1 above. The experiment was conducted in essentially the same manner as example 1, except that 2000 APSU/kg fiber of pectate lyase were added after sodium sulfate. The pH of the bath was 7.84 prior to the addition of pectate lyase. The analysis was performed as for Example 1.

The results of the panel score and L*a*b* values are shown in Table 1 below. The colored fabric prepared using a combination of pectate lyase and dyeing has an improved blue color intensity (as indicated by b* value) was improved as compared with a fabric dyed without pectate lyase (control fabric, Example 1), though the shade was somewhat lighter than the control fabric. The pectate lyase-treated fabric was also brighter than the control fabric. The overall color shade including dyeing uniformity was better for the pectate lyase-treated fabric than for the control fabric.

EXAMPLE 3

Effect of EDTA on One-Bath Scouring and Dyeing

The same fabric and equipment were used as in Example 2 above. The experiment was carried out in essentially the same manner as in Example 2, except that that 0.2 g/l sodium (tetra) ethylenediamine tetraacetate was added after sodium sulfate addition and prior to pectate lyase addition. The pH of the bath was 7.90 after the addition of dye (Reactive Navy Blue FG, i.e. Colour Index Reactive Blue 184). The liquor to fabric ratio was changed to 15:1 and dyeing temperature was changed to 60° C. for the same period of time.

The results of the panel score and L*a*b* values are presented in Table 1 below. Compared with fabric not treated with pectate lyase (Example 1), the bioscoured fabric exhibited an improved blue color intensity as indicated by b* value. This fabric also had a darker shade and less streaking. The overall color shade including dyeing uniformity was the best among the fabric of Examples 1–3.

TABLE 1

Color and dyeing properties of fabrics from example 1–3

| Example | Color Eye Measurement | | Dyeing Properties in Panel Test | | |
|---|---|---|---|---|---|
| # | L* | b* | Lightness | Streaking | Overall Shade |
| 1 | 29.14 | −18.33 | Medium | Some | Good |
| 2 | 29.92 | −18.40 | Lightest | Some | Better |
| 3 | 28.55 | −18.41 | Darkest | Best | Best |

EXAMPLE 4

Sequential Bioscouring and Dyeing

The same fabric and equipment were used as described in Examples 1–3 above. The same pre-rinsing step was performed. However, in this experiment, bioscouring using pectate lyase was performed prior to dyeing.

A. Bioscouring: A solution containing 0.5 g/l lubricant Multiplus NB 100, 2 mM sodium tetra borate, and 0.2 g/l sodium (tetra) ethylenediamine tetraacetate (EDTA) was added to the jet to obtain a liquor-to-fabric ratio of 10:1. The solution pH was adjusted to 9.0 and the solution was heated to 55° C. Pectate lyase was added as in Example 2, and the solution was maintained at 55° C. for 20 minutes.

B. Dyeing: After adjusting the pH to 7.5, a solution containing sodium sulfate was added to the jet dyer to achieve a liquor-to-fabric ratio of 15:1 and a concentration of sodium sulfate of 22 g/l. Reactive Navy FG was dissolved and added to the jet over 8 minutes as in Examples 1–3. The solution was then heated to 60° C. at 4° F./minute and circulated for 40 minutes at 60° C. Sodium carbonate was then added to a concentration of 5.85 g/l over 15 minutes and the solution was circulated for 30 more minutes. The dye solution was then drained and post-treatment was performed as in Example 1.

The results indicated that fabric dyed in this manner had a darker shade than any of the fabrics described in Examples 1–3. It also exhibited less streaking than any of the fabrics of Examples 1–3. The overall rating, including the uniformity of dyeing judged by a panel, was the best of Examples 1–4.

EXAMPLE 5

Effect of Sodium Sulfate on Single-Bath Scouring and Dyeing

The following experiment was performed to test whether sodium sulfate, which is almost always used to increase dye adsorption in the dyeing of cellulose with direct, reactive, sulfur, and vat dyes, has any effect on the activity of pectate lyase.

A buffer containing 2 mM borate at pH 9.2 and 1 g/l nonionic surfactant Tergitol 15-S-12 was prepared. The solution was transferred to Labomat beakers (Werner-Mathis USA, Inc., North Carolina). A variable amount (0–100 g/l) of sodium sulfate was added to each beaker. Swatches of a woven fabric (type 480U from Testfabrics, Inc., Pennsylvania) were then added to the beakers so that the liquor-to-fabric ratio was 10 ml/g. After the temperature was raised to 60° C., 2000 APSU/kg fiber of pectate lyase were added and the fabric was incubated at 60° C. for 30 minutes. The swatches were then removed and rinsed twice in hot and cold water.

The amount of residual pectic substances remaining on the fabric was determined by measuring the color strength of the fabric dyed with Ruthenium red, a dye with an affinity for pectic substances. For the Ruthenium red assay, a fresh solution was prepared containing 0.2 g/l Ruthenium red, 1.0 g/l ammonium chloride, 2.5 ml/l 28% ammonium hydroxide solution, 1.0 g/l Silwet L-77 (Wetter, Polyalkyleneoxide modified heptamethyltrisiloxane), and 1.1 g/l Tergitol 15-S-12. The solution was used at a ratio of 100 ml solution/gram of fabric. Fabric swatches were dyed at room temperature in Labomat beakers for 15 minutes and then rinsed with cold water. After drying, the color of swatches was assessed by measuring the reflectance of the Ruthenium red-dyed fabric on Macbeth color eye at 540 nm, and the dye on the fabric was calculated as K/S value.

The results are shown in FIG. 1. As the concentration of sodium sulfate changes, the residual pectic substance on fabric changes. Initially, increasing the amount of sodium sulfate results in a decrease of residual pectic substances. At about 20 g/l sodium sulfate, a minimum amount of pectic residue was left on the fabric. Further increases in sodium sulfate resulted in an increase in the amount of pectic residue, i.e., a decrease in pectate lyase efficacy.

These results demonstrate that bioscouring and dyeing can be carried out in the presence of concentrations of sodium sulfate conventionally used in dyeing. At higher concentrations of sodium sulfate, additional pectate lyase should be added in order to achieve the same scouring effect. Alternatively, a sequential scouring and dyeing process (such as described, e.g., in example 4) should be selected.

EXAMPLE 6

Comparison of Single-Bath Biopreparation and Dyeing with Traditional Alkaline Two-step Scouring and Dyeing The following experiment was performed to compare the method of the invention with traditional two-step scouring and dyeing procedures.

Two interlock knitted fabrics were used: (i) knit 460U (TestFabrics, Inc., West Pittston, Pa.), which has limited amount of lubricant and chemical additives, and (ii) knit 4600 (Ramseur Interlock Knitting Co. Inc., North Ramseur, N.C.), which has heavy lubricant additives. The two types of fabrics were sewed together to form a tube. The tube was rinsed with 0.25 g/l wetting agent Basophen M (BASF, Charlotte, N.C.) at 40° C. at a 10:1 (ml/g) liquor/fabric ratio for 10 minutes to at least partially remove lubricant additives. The rinsing and all following processes were conducted in a Jet dyer (JFO type from Werner Mathis, Charlotte, N.C.). The jet operated at 85 l/minute and fabric passed over the winch at 10 m/minute.

Conventional alkaline scouring and mild alkaline scouring were conducted at 90° C. and 60° C., respectively. Bioscouring was carried out at 55° C. All scouring processes were at a 10:1 liquor/fabric ratio in a jet dyer for 15 minutes. Enzyme and chemicals were use as specified in the Table 2. Kierlon Jet B is a surfactant from BASF. Dekol SN is a chelating agent from BASF. Sodium phosphate and sodium carbonate were from Fisher. In conventional alkaline scouring, the fabric was rinsed at 75° C. for 15 minutes (overflow) and then at 50° C. 10 minutes after alkaline treatment. For mild alkaline scouring, 15 minutes overflow rinsing at 55° C. and then 50° C. 10 minutes rinsing were performed prior to dyeing and after alkaline treatment. The purpose of these rinses in the alkaline process is to remove non-cellulose impurities and to lower pH. No draining and rinsing were needed for bioscouring, and dyeing was performed using the same biopreparation bath.

TABLE 2

Chemicals and enzyme used in Example 6

| Process | Chemical | Conventional scour, then dyeing | Mild Alkaline scour, then dyeing | Single bath bioscour and dyeing |
|---|---|---|---|---|
| Scouring | Kierlon Jet B con. (g/l) | 1 | 1 | 1 |
| | Dekol SN (g/l) | 2 | 1 | |
| | Sodium carbonate (g/l) | 2 | 0.5 | |
| | Sodium phosphate (g/l of $Na_2HPO_4.7H_2O$) | | | 0.54 |
| | Pectate lyase (APSU/kg) | | | 1000 |
| Dyeing | Kierlon Jet B con. (% owf) | 1 | | |
| | Dextralube SS-3000 (% owf) | 1 | 1 | 1 |
| | Sodium sulfate (g/l) | 20 | 20 | 20 |
| | Reactive Navy FG (% owf) | 3 | 3 | 3 |
| | Sodium carbonate (g/l) | 6 | 6 | 6 |
| Soaping | Kierlon Jet B con. (g/l) | | | 1 |
| | Dekol SN (g/l) | 1 | 1 | 1 |

Dyeing was performed as follows for all scoured fabric. Dextrolube (Dextel Chemical Co., Charlotte, N.C.), Kierlon Jet B, and sodium sulfate were dissolved and added. The dye was then dissolved and added at 40° C. and the final liquor/fabric ratio was changed to 15:1. The solution was heated to 60° C. at 2.5° C./ minutes. The fabric was dyed at 60° C. for 30 minutes. After adding sodium carbonate over 15 minutes to the dyeing bath, the fabric was dyed for 15 more minutes. The dyeing solution was then drained.

After dyeing, three rinsing processes were carried out and the rinsing solution was drained each time. The first was at warm temperature for 10 minutes. The second rinsing or soaping was at 90° C. for 10 minutes with chemicals shown in Table 2. Finally, the fabric was overflow rinsed until wastewater was clear (about 10 minutes).

The wetting test was performed using water according to AATCC Test Method 79–1992. Five measurements were taken from each of three areas along the fabric in this water drop test. Color measurements were made using reflectance Macbeth Color Eye System with Optiview 1.7 software, using 100 standard observer and illuminant D65, which represents average daylight over range of 380–830 nm. Ten measurements at different positions of fabric tube were carried out.

The results are shown in Table 3 below. Both fabrics subjected to biopreparation and dyeing exhibited good wettability (<1 second for both fabrics). Fabrics after conventional scouring and dyeing exhibited good wettability (<1 second for both fabrics). However, fabrics subjected to mild alkaline scouring and dyeing have poor wettability, where the wetting time is 41 and >60 seconds for TestFabric and Ramseur fabric, respectively. There is no significant difference of the color yield of the dyed fabrics in alkaline treatments regardless of fabric type as indicated by CIELAB (L*, a*, b*) values. However, single-bath bioprepared and dyed fabric differs slightly from the others. The fabric is lighter (higher L*), greener (higher negative a*) and bluer color (higher negative b*). A panel of two ranked this fabric better, in color uniformity and fabric hand and smoothness.

TABLE 3

Properties of bioscoured and dyed fabric and alkaline scoured and dyed fabrics from Example 6

| | Conventional scour, then dyeing | | Mild Alkaline scour, then dyeing | | Single bath bioscour and dyeing | |
|---|---|---|---|---|---|---|
| | Test Fabric | Ramseur | Test Fabric | Ramseur | Test Fabric | Ramseur |
| Wetting time(s) | <1 | <1 | 41 | >60 | <1 | <1 |
| L* | 26.40 | 25.41 | 26.19 | 25.19 | 28.00 | 26.53 |
| a* | −4.83 | −4.64 | −4.74 | −4.61 | −5.37 | −5.12 |
| b* | −17.98 | −17.68 | −17.98 | −17.64 | −18.57 | −18.03 |

EXAMPLE 7

Effect of Pectinase Dosage, Chelating Agent and Surfactant in Single Bath Biopreparation and Dyeing The following experiment was performed to test the effects of varying different parameters on single-bath biopreparation and dyeing.

The fabrics, their preparation, and use of the Mathis Jet were as described in Example 6. During bioscouring and dyeing, Kierlon Jet B, Dextralube, and phosphate were dissolved and added in jet. After circulating the solution for 5 minutes, the enzyme was added and circulated for 5 minutes. The pH was adjusted to 8.5 over the circulation period. The bath solution was then heated to 45° C. at 4° C./minute and scouring was conducted for 15 minutes at 45° C. After the bath pH dropped below 7.5 (using acidic acid if needed), pre-dissolved sodium sulfate was added. Pre-dissolved dye was added over 5 minutes at about 35° C., and liquor/fabric ratio changed from 10:1 to about 15:1. The temperature was raised to 60° C. at 2.5° C./minute. After circulating at 60° C. for 30 minutes, carbonate was added over 15 minutes and the bath was circulated for 15 more minutes and drained. The chemicals and enzymes are presented in Table 4.

TABLE 4

Chemicals and enzyme used in Example 7

| Process | Chemical | Trial A | Trial B | Trial C | Trial D |
|---|---|---|---|---|---|
| Scouring & Dyeing | Kierlon Jet B con. (g/l) | 1 | | | |
| | Dextralube SS-3000 (% owf) | 1 | | | |
| | Sodium phosphate (g/l of $Na_2HPO_4.7H_2O$) | 0.54 | 0.54 | 0.54 | 0.54 |
| | Pectate lyase (APSU/kg) | 2000 | 1000 | 1000 | 0 |
| | Sodium sulfate (g/l) | 20 | 20 | 20 | 20 |
| | Reactive Navy FG (% owf) | 3 | 3 | 3 | 3 |

TABLE 4-continued

Chemicals and enzyme used in Example 7

| Process | Chemical | Trial A | Trial B | Trial C | Trial D |
|---|---|---|---|---|---|
| | Sodium carbonate (g/l) | 6 | 6 | 6 | 6 |
| Soaping | Kierlon Jet B con. (g/l) | 1 | 1 | 0.5 | 0.5 |
| | Dekol SN (g/l) | 1 | 1 | 0.5 | 0.5 |

Three rinses were conducted as described in example 6. Chemicals (in Table 4) were used during soaping stage. The fabric was unloaded from the jet, extracted to remove excess liquor, and dried at 200° C. for 45 minutes. The wetting test and color measurements were conducted as described in example 6.

The results are shown in Table 5. The effect of pectinase concentration is clearly demonstrated in trial C and D. Increasing the pectinase dosage from 0 to 1000 APSU/kg fabric resulted in much better fabric wettability. Increasing the chelating agent and surfactant in soaping also resulted in better fabric wettability as shown in trial B and C. Further increases in the chelating agent and surfactant in the scouring and dyeing bath do not result in a wettability difference, which may be due to the limitation of the sensitivity of test method. We conclude that the concentration of enzyme, chelating agent and surfactant has an important impact on scouring. There was no significant color difference in this set of trials.

It should be noted that trial A is the same as single bath biopreparation and dyeing trial in Example 6, except that the temperature is 45° C. in A and 55° C. in Example 6. The color is slightly darker in trial A. By comparing the color results from alkaline scouring in Example 6, we conclude that a temperature of 45° C. in single bath biopreparation and dyeing simulates the color of alkaline scoured and dyed fabric better.

bath solution was then heated to 50° C. at 4° C./minute and scouring was conducted for 15 minutes at 50° C. After the bath pH was below 7.5 (using acidic acid if needed), pre-dissolved sodium sulfate was added. Dissolved dye was added over 5 minutes at about 35° C., and the liquor/fabric ratio changed from 10:1 to about 15:1. The temperature was raised to 60° C. at 2.5° C./minute. After circulating at 60° C. for 30 minutes, carbonate was added over 15 minutes and the bath was circulated for 15 more minutes and drained. The chemicals and enzymes are presented in Table 6. Durazym 16.0L EX has activity of 16.0DPU/g and is a commercial protease product of Novo Nordisk.

TABLE 6

Chemicals and enzyme used in Example 8

| Process | Chemical | Trial A | Trial B | Trial C | Trial D |
|---|---|---|---|---|---|
| Scouring & Dyeing | Dextrol Defoamer NT-5. (% owf) | 0.3 | 0.3 | 0.3 | 0.3 |
| | Dextralube SS-3000 (% owf) | 1 | 1 | 1 | 1 |
| | Clavodene TU-5 (% owf) | 1.5 | 1.5 | 1.5 | 1.5 |
| | Sodium phosphate (g/l of $Na_2HPO_4.7H_2O$) | 0.54 | 0.54 | 0.54 | 0.54 |
| | Pectate lyase (APSU/kg) | 0 | 2000 | 0 | 2000 |
| | Durazym 16.0L EX (ml/l) | 0 | 0 | 1 | 1 |
| | Sodium sulfate (g/l) | 20 | 20 | 20 | 20 |
| | Reactive Navy FG (% owf) | 3 | 3 | 3 | 3 |
| | Sodium carbonate (g/l) | 6 | 6 | 6 | 6 |
| Soaping | Kierlon Jet B con. (g/l) | 0.5 | 0.5 | 0.5 | 0.5 |
| | Dekol SN (g/l) | 0.5 | 0.5 | 0.5 | 0.5 |

Three rinses were conducted as in Example 6. Chemicals (in Table 6) were used during soaping stage. The fabric was unloaded from jet, extracted to remove excess liquor, and dried at 200° C. for 45 minutes. The wetting test and color measurements were conducted as described in Example 6.

The results are shown in Table 7. Test fabrics treated with no enzyme, pectinase, protease, or a pectinase/protease

TABLE 5

Properties of fabric treated with protease and/or pectate lyase in Example 7

| Trial: | A | | B | | C | | D | |
|---|---|---|---|---|---|---|---|---|
| Fabric | TF | Ram | TF | Ram | TF | Ram | TF | Ram |
| Wetting (S) | <1 | <1 | <1 | <1 | <1 | 5.9 | 5.6 | 51.1 |
| L* | 27.56 | 26.25 | 27.63 | 26.35 | 27.19 | 26.02 | 27.64 | 26.10 |
| a* | −5.28 | −5.07 | −5.27 | −5.07 | −5.16 | −4.97 | −5.32 | −5.07 |
| b* | −18.52 | −17.94 | −18.57 | −17.98 | −18.48 | −17.96 | −18.51 | −17.91 |

EXAMPLE 8

Single Bath Biopreparation and Dyeing Using Protease and Pectate Lyase

The following experiment was performed to test the use of protease as a bioscouring enzyme in single-bath bioscouring and dyeing.

The fabrics, their preparation, and operation of the jet dryer were as described in Example 6. During the experiment, Dextrol defoamer, Dextralube, Clavodene (all from Dexter Chemical, Charlotte, N.C.) and phosphate were dissolved and added in jet. After circulating the solution for 5 minutes, enzyme was added and circulated for 5 minutes. The pH was adjusted to 8.5 over the circulation period. The mixture exhibited fabric wetting times of 2.7, <1, <1, and <1 second, respectively. Ramseur fabrics treated with no enzyme, pectinase, protease, or a pectincase/protease mixture exhibited fabric wetting times of 35.7, ≦1, 13.4, and <1–3 seconds, respectively. From these data, we conclude that either pectinase or protease exerts a scouring effect and can be used alone in combined biopreparation and dyeing. The mixture of protease and pectinase shows an improved scouring effect relative to protease alone, but not better than pectinase alone. Possibly, the protease may hydrolyze some pectinase when added at the same time; thus, a better result is expected when adding pectinase and protease in a sequential manner. There is no significant color difference for the same fabric from trial A to D. The color difference between Test and Ramseur fabrics reflects the original color difference of the fabrics.

TABLE 7

Properties of fabric treated with protease and/or pectate lyase in Example 8

| | A: Control | | B: Pectinase | | C: Protease | | D: Protease & Pectinase | |
|---|---|---|---|---|---|---|---|---|
| Fabric | TF | Ram | TF | Ram | TF | Ram | TF | Ram |
| Wetting (S) | 2.7 | 35.7 | <1 | ≦1 | <1 | 13.4 | <1 | <1 to 3 |
| L* | 27.70 | 26.27 | 27.73 | 26.41 | 28.30 | 26.86 | 28.58 | 26.87 |
| a* | −5.30 | −5.05 | −5.27 | −5.06 | −5.44 | −5.22 | −5.45 | −5.16 |
| b* | −18.46 | −17.91 | −18.52 | −18.01 | −18.64 | −18.10 | −18.73 | −18.14 |

EXAMPLE 9

Single Bath Biopreparation and Dyeing Using Lipase and Pectate Lyase

The following experiment was performed to test the use of lipase as a bioscouring enzyme in single-bath bioscouring and dyeing.

The fabrics, their preparation, and operation of the jet dryer were as described in Example 6. The experimental procedure was exactly the same as in Example 8 so that the results in trial A and B of Example 8 can be used for comparison. In trial E and F, Lecitase was used to replace Duryzym in trial C and D of Example 8. The chemicals and enzymes are presented in Table 8. Lecitase™ 10L is a commercial phospholipase product of Novo Nordisk. It has activity of 10,000 LU/ml (Lecitase Unit).

TABLE 8

Chemicals and enzyme used in Example 9

| | | Trial | | | |
|---|---|---|---|---|---|
| Process | Chemical | A | B | E | F |
| Scouring & Dyeing | Dextrol Defoamer NT-5. (% owf) | 0.3 | 0.3 | 0.3 | 0.3 |
| | Dextralube SS-3000 (% owf) | 1 | 1 | 1 | 1 |
| | Clavodene TU-5 (% owf) | 1.5 | 1.5 | 1.5 | 1.5 |
| | Sodium phosphate (g/l of $Na_2HPO_4.7H_2O$) | 0.54 | 0.54 | 0.54 | 0.54 |
| | Pectate lyase (APSU/kg) | 0 | 2000 | 0 | 2000 |
| | Lecitase 10L (ml/l) | 0 | 0 | 3 | 3 |
| | Sodium sulfate (g/l) | 20 | 20 | 20 | 20 |
| | Reactive Navy FG (% owf) | 3 | 3 | 3 | 3 |
| | Sodium carbonate (g/l) | 6 | 6 | 6 | 6 |
| Soaping | Kierlon Jet B con. (g/l) | 0.5 | 0.5 | 0.5 | 0.5 |
| | Dekol SN (g/l) | 0.5 | 0.5 | 0.5 | 0.5 |

The wetting test and color measurements were conducted as described in example 6.

The results are shown in Table 9. It is evident that lipase improves fabric wettability as shown in trial E and A. The scouring effect of lipase is significant for both fabrics. When lipase and pectinase are used together, fabric wettability is improved compared to lipase alone, and is equivalent to pectinase alone. The later case may be due to the sensitivity of test method. For the same fabric, there is no color difference between trials.

TABLE 9

Properties of fabric treated with protease and/or pectate lyase in Example 9

| | A: Control | | B: Pectinase | | E: Lipase | | F: Lipase & Pectinase | |
|---|---|---|---|---|---|---|---|---|
| Fabric | TF | Ram | TF | Ram | TF | Ram | TF | Ram |
| Wetting (S) | 2.7 | 35.7 | <1 | ≦1 | <1 | 5.7 | <1 | ≦1 |
| L* | 27.70 | 26.27 | 27.73 | 26.41 | 26.52 | 25.45 | 27.47 | 26.45 |
| a* | −5.30 | −5.05 | −5.27 | −5.06 | −5.03 | −4.88 | −5.22 | −5.08 |
| b* | −18.46 | −17.91 | −18.52 | −18.01 | −18.33 | −17.90 | −18.56 | −18.00 |

EXAMPLE 10

Single Bath Biopreparation and Dyeing Using High Temperature Dye

The following experiment was performed to test the use of high-temperature dyes in single-bath bioscouring and dyeing.

The fabrics, their preparation, and use of the Mathis Jet were as described in Example 6. During the experiment, Dextrol defoamer, Dextralube, Clavodene (all from Dexter Chemical, Charlotte, N.C.) and phosphate were dissolved, added in jet, and circulated the solution for 5 minutes as in Example 8. Enzyme was added and circulated for 5 minutes. The pH was adjusted to 8.5 over the circulation period. The bath solution was then heated at 4° C./minute to 50° C. and kept for 15 minutes. After the bath pH was adjusted to below 7.5 (using acidic acid if needed), pre-dissolved sodium sulfate was added. A pre-dissolved high temperature dye, Procien Navy H-EXL (from BASF), was added over 5 minutes at 50° C., and the liquor/fabric ratio was kept at 10:1. The temperature was raised to 80° C. at 2.5° C./minute. After circulating at 80° C. for 30 minutes, carbonate was added over 15 minutes and the bath was circulated for 45 more minutes and drained. The chemicals and enzymes are presented in Table 10. Durazym 16.0L EX is a commercial protease product with 16.0 DPU/g activity. Denimax 301S is a commercial cellulase product with activity of 1000 ECU/g. Both Durazym and Denimax 301S are produced by Novo Nordisk.

TABLE 10

Chemicals and enzyme used in Example 10

| Process | Chemical | Trial A | Trial B | Trial C | Trial D |
|---|---|---|---|---|---|
| Scouring & Dyeing | Dextrol Defoamer NT-5. (% owf) | 0.3 | 0.3 | 0.3 | 00.3 |
| | Dextralube SS-3000 (% owf) | 1 | 1 | 1 | 1 |
| | Clavodene TU-5 (% owf) | 1.5 | 1.5 | 1.5 | 1.5 |
| | Sodium phosphate (g/l of $Na_2HPO_4.7H_2O$) | 0.54 | 0.54 | 0.54 | 0.54 |
| | Pectate lyase (APSU/kg) | 2000 | 2000 | 2000 | 2000 |
| | Sodium tetra poly-phosphate (g/l) | | 2 | | |
| | Denimax 301S (ECU/g fabric) | | | 20 | |
| | Durazym 16.0L EX (ml/l) | | | | 1 |
| | Sodium sulfate (g/l) | 80 | 80 | 80 | 80 |
| | Procion Navy H-EXL (% owf) | 3 | 3 | 3 | 3 |
| | Sodium carbonate (g/l) | 6 | 6 | 6 | 6 |
| Soaping | AATCC detergent. (g/l) | 1 | 1 | 1 | 1 |
| | Dextrol defoamer NT-5 (g/l) | 0.3 | 0.3 | 0.3 | 0.3 |

Four rinses were conducted. The first rinsing was overflow at 70° C. for 10 minutes. Chemicals (in Table 10) were used during soaping stage or second rinsing at 90° C. for 10 minutes. The third rinsing was the same as the first rinsing. The final rinsing was conducted with cold water for 5 minutes. The fabric was unloaded from jet, extracted to remove excess liquor, and dried at 200° C. for 45 minutes. The wetting test and color measurements were conducted as described in example 6. Color fastness properties were evaluated in triplicates according to AATCC Color Fastness to Laundering 61-IIA, AATCC Light Fastness 16-I, and AATCC Crock Fastness 8. The strength loss of fabric was measured according to ASTM D3786–87 (Hydraulic Bursting Strength of knitted Goods and Nonwoven Fabric-Diaphragm Bursting Strength Tester Method). Ten replicates were measured for each fabric and average number and standard deviation are given. Pilling was measured according to ASTM D 4970–89 (Pilling Resistance and Other Related Changes of Textile Fabrics-Martindale Pressure Tester Method). Pilling was rated by visually comparison the swatch with standard photographs on a 1–5 scale, where 5 is no pilling and 1 is very severe pilling.

The wetting results are shown in FIG. 2. It is evident that addition of sodium tripoly phosphate (STPP), or cellulase (Denimax), or protease (Durazym) to pectincase biopreparation and dyeing solution resulted in better wettability (or better scouring) of cotton fabric as indicated by a lower wetting time in the drop test. The difference of wettability between Test fabric and Ramseur fabric reflects the difference of original fabric quality.

Color and color fastness results are shown in Tables 11–12. There was no significant color change among trials. There was a color difference between the two fabrics treated at the same conditions, which reflects the original color difference of fabrics. The color fastness was determined in triplicate by at least three people. The average data and standard deviation are given here. It is evident that addition of cellulase increased fabric light fastness and decreased crock fastness regardless of fabric type. There was no other difference observed for color fastness properties as well as color as indicated by CIELAB values.

The mechanic properties of Ramseur fabric are shown in Table 13. The time until fabric breaking, fabric stretching distance (i.e. destention), and pressure at breaking are presented. Addition of cellulase to pectinase scouring and dyeing solution resulted in similar breaking pressure but less destention, which indicates more mechanical strength loss of the fabric. Addition of STPP or protease results in inconclusive conclusions as indicated by higher breaking pressure but lower destention.

The addition of cellulase to bioscouring and dyeing bath improved fabric resistance to pilling. This is evident by the significant difference in pilling note, which were 3 and 2 after 500 revolutions on a Nu-Martindale pilling tester (from James H. Heal & Co. Ltd.) for fabric treated with and without addition of cellulase, respectively. Thus, addition of cellulase to a biopreparation and dyeing solution can also achieve enzymatic finish (also called biopolishing) effect for cotton, thus combining which combining biopolishing, biopreparation and dyeing in one bath.

TABLE 11

Color of fabrics in Example 10

| Trial | CIELAB Values L* | a* | b* |
|---|---|---|---|
| Test Fabric | | | |
| A | 27.03 ± 0.25 | −3.21 ± 0.19 | −17.67 ± 0.07 |
| B | 27.35 ± 0.14 | −3.31 ± 0.10 | −17.79 ± 0.10 |
| C | 27.46 ± 0.22 | −3.38 ± 0.12 | −17.68 ± 0.06 |
| D | 27.74 ± 0.11 | −3.39 ± 0.09 | −17.87 ± 0.03 |
| Ram. Fabric | | | |
| A | 26.16 ± 0.21 | −3.20 ± 0.13 | −17.30 ± 0.06 |
| B | 26.46 ± 0.19 | −3.17 ± 0.11 | −17.48 ± 0.06 |
| C | 26.62 ± 0.17 | −3.30 ± 0.11 | −17.24 ± 0.08 |
| D | 26.79 ± 0.14 | −3.22 ± 0.11 | −17.40 ± 0.06 |

TABLE 12

Color fastness of fabrics in Example 10

| Trial | Washing Fastness | Washing Staining | Light Fastness | Crock Fastness Wet | Crock Fastness Dry |
|---|---|---|---|---|---|
| Test Fabric | | | | | |
| A | 4.8 ± 0.3 | 5.0 ± 0.0 | 4.1 ± 0.3 | 4.0 ± 0.4 | 5.0 ± 0.0 |
| B | 4.8 ± 0.3 | 5.0 ± 0.0 | 4.1 ± 0.4 | 4.0 ± 0.4 | 5.0 ± 0.0 |
| C | 4.8 ± 0.3 | 5.0 ± 0.0 | 4.5 ± 0.4 | 3.8 ± 0.5 | 4.5 ± 0.0 |
| D | 4.8 ± 0.3 | 5.0 ± 0.0 | 4.2 ± 0.2 | 3.9 ± 0.4 | 4.9 ± 0.0 |

TABLE 12-continued

Color fastness of fabrics in Example 10

| Trial | Washing Fastness | Washing Staining | Light Fastness | Crock Fastness Wet | Crock Fastness Dry |
|---|---|---|---|---|---|
| Ram. Fabric | | | | | |
| A | 5.0 ± 0.1 | 5.0 ± 0.0 | 4.3 ± 0.3 | 3.8 ± 0.3 | 5.0 ± 0.0 |
| B | 5.0 ± 0.0 | 5.0 ± 0.0 | 4.2 ± 0.3 | 3.7 ± 0.3 | 5.0 ± 0.0 |
| C | 4.9 ± 0.2 | 5.0 ± 0.0 | 4.5 ± 0.1 | 3.6 ± 0.2 | 5.0 ± 0.0 |
| D | 5.0 ± 0.1 | 5.0 ± 0.0 | 4.1 ± 0.2 | 3.8 ± 0.3 | 5.0 ± 0.0 |

TABLE 13

Mechanical properties of fabrics from Example 10

| Trial No | Average Time (sec.) | Average Distention (mm) | Average Pressure (psi) | STDEV Time (sec.) | STDEV Distention (mm) | STDEV Pressure (psi) |
|---|---|---|---|---|---|---|
| A | 12.51 | 17.72 | 118.24 | 0.48 | 0.32 | 3.85 |
| B | 12.65 | 16.84 | 125.49 | 0.51 | 0.27 | 4.44 |
| C | 11.67 | 16.91 | 119.92 | 0.54 | 0.15 | 4.46 |
| D | 12.59 | 17.04 | 123.64 | 0.88 | 0.28 | 7.87 |

EXAMPLE 11

Compatibility of Pectate Lyase with Dyes in Analytical Assay

An analytical assay is used in compatibility tests. Prior to this assay, 5 mM phosphate buffer pH 8.5 is made up using $KH_2PO_4$ and NaOH (both from Fisher). The other solutions are constituted as follows:

i) The substrate is polygalacturonic acid in sodium salt form (from SIGMA). The substrate solution is made up to 11.436 g/l by dissolving polygalacturonic acid sodium salt in the phosphate buffer.

ii) Dye solutions are made up to 10 g/l by dissolving a commercial dye in the phosphate buffer.

iii) An internal standard pectate lyase (2600 APSU/g) is used. The enzyme solution is made up to 500 APSU/ml by dissolving the pectate lyase in the phosphate buffer.

During the assay, 3.5 ml substrate solution was pipetted into each tube. 0.5 ml of a dye solution or buffer was added and mixed well. The tube was then preheated in 40° C. water bath for 5 minutes. A total of 0.5 ml solution, including enzyme, and buffer was added using Hamilton Micro Lab 900. In dye compatibility, the 0.5 ml solution was made up with 40 μl enzyme solution and 460 μl buffer. For standard curve, 0–90 μl enzyme solution was used. Once enzyme was added, the solution was mixed immediately and the tube incubated at 40° C. for 20 minutes. The viscosity was then measured after putting the tube on a vibration viscometer (Sofraser Viscometer-mivi 3000, from France) for 10 seconds. At all conditions, experiments were performed in duplicate.

TABLE 13

Compatibility of reactive dyes with pectate lyase

| Source | Commercial Name | C.I. Structure | C.I. Name | % Activity |
|---|---|---|---|---|
| | no dye | | | 100.0 |
| BASF | Procion Crimson H | | | 101.4 |
| | Procion Navy HEXL | | | 106.8 |
| | Procion Br. Orange HEXL | | | [illegible] |
| | Procion Blue HEXL | | | [illegible] |
| | Procion Yellow HEXL | | | [illegible] |
| Melatex | Reactive Navy FG | | | 119.9 |
| DyStar | Remazol Br. Violet 5R | 18097 | Violet 5 | 112.4 |
| | Remazol Br. Red 3BS | | Red 239 | 116.2 |
| | Remazol Gold Yellow RNL | | | 114.8 |
| | Remazol Black B | 20505 | Black 5 | 114.8 |
| | Remazol Br. Blue R Spec. | 61200 | Blue 19 | [illegible] |
| | Levafix Navy Blue E-BNA | 205069 | Blue 225 | [illegible] |
| | Remazol Br. Orange 3R | 17757 | Orange 16 | 110.1 |
| Ciba | Lanasol Red 5B | 17555 | Red 66 | 117.6 |
| | Cibacron Blue P-3R | | | 117.6 |
| | Cibacron Navy C-B | 205055 | Blue 238 | 111.3 |

A standard linear curve was obtained within 0–5 APSU/ml pectate lyase concentration range (0–45 μl enzyme solution added). The correlation is given in the equation below:

$$Y=216.68-16.493\,X\ (R^2=0.9944)$$

Where:

Y is viscosity reading

X is enzyme activity in APSU/ml

Since the Y was obtained from experimental measurements, X was then calculated using the above equation. The enzyme activity with the addition of dye was compared to the activity of none-dye control. The relative activity is illustrated in Table 13. All relative activities were above 100%, which indicates that all commercial dyes used here are compatible with pectate lyase enzyme. Since the chromophore structure of reactive dye shares similar chemical structure of direct dye and other dye classes, similar compatibility results may be expected for other dye classes. The results show that a few dyes have positive impact on enzyme activity. Since commercial dyes are not pure and often contains salt, the positive impact may be due to the salt in dye formula. The effect of salt on enzyme activity has been demonstrated in Example 5.

All patents, patent applications, and literature references referred to herein are hereby incorporated by reference in their entirety.

Many variations of the present invention will suggest themselves to those skilled in the art in light of the above detailed description. Such obvious variations are within the full-intended scope of the appended claims.

What is claimed is:

1. A method for single-bath scouring and dyeing of cellulosic fibers, said method comprising contacting the fibers with (i) a bioscouring enzyme selected from the group consisting of pectinase, protease, lipase, and combinations of any of the foregoing and (ii) a dyeing system, wherein the bioscouring enzyme and the dyeing system are added simultaneously or sequentially to a single solution containing the fibers.

2. A method as defined in claim 1, wherein the bioscouring enzyme and the dyeing system are added substantially simultaneously to the solution containing the fibers.

3. A method as defined in claim 1, wherein the fibers are (a) contacted with the bioscouring enzyme, for a sufficient time and under appropriate conditions that result in removal of at least 20% of the pectin present in the fibers, after which (b) the dyeing system is added directly to the solution containing the fibers and the bioscouring enzyme.

4. A method as defined in claim 3, further comprising, between steps (a) and (b), adjusting a property of the solution selected from the group consisting of pH, ionic strength, temperature, concentration of surfactant, concentration of divalent cationic chelator, and combinations of any of the foregoing.

5. A method as defined in claim 1, wherein the contacting is performed at a temperature above about 30° C.

6. A method as defined in claim 1, wherein the contacting is performed at a pH of at least about 6.5.

7. A method as defined in claim 1, wherein said single solution further comprises one or more buffers, surfactants, chelating agents, and/or lubricants, or salts of any of the foregoing.

8. A method as defined in claim 7, wherein the pectinase is selected from the group consisting of pectate lyase (EC 4.2.2.2), pectin lyase (EC 4.2.2.10), polygalacturonase (EC 3.2.1.15), exo-polygalacturonase (EC 3.2.1.67), exo-polygalacturonate lyase (EC 4.2.2.9) and exo-poly-alpha-galacturonosidase (EC 3.2.1.82).

9. A method as defined in claim 8, wherein the pectinase is pectate lyase.

10. A method as defined in claim 7, wherein the protease is selected from the group consisting of aminopeptidases, serine endopeptidases, cysteine endopeptidases, aspartyl endopeptidases, and metalloendopeptidases.

11. A method as defined in claim 7, wherein the lipase is selected from the group consisting of triacylglycerol lipases and phospholipases.

12. A method as defined in claim 1, wherein said fibers are contacted with between about 1 and about 2,000 mol/min/kg fiber bioscouring enzyme.

13. A method as defined in claim 12, wherein said fibers are contacted with between about 10 and about 500 mol/min/kg fiber bioscouring enzyme.

14. A method as defined in claim 9, wherein the bioscouring enzyme exhibits maximal pectate lyase enzymatic activity at a temperature above about 70° C.

15. A method as defined in claim 9, wherein the bioscouring enzyme exhibits maximal pectate lyase enzymatic activity at a pH above about 8.

16. A method as defined in claim 9, wherein the pectate lyase enzymatic activity of the enzyme is independent of the presence of divalent cations.

17. A method as defined in claim 1, wherein the bioscouring enzyme is derived from a Bacillus species.

18. A method as defined in claim 17, wherein the species is selected from the group consisting of *B. licheniformis, B. agaradhaerens, B. alcalophilus, B. pseudoalcalophilus, B. clarkii, B. halodurans, B. lentus, B. clausii,* and *B. gibsonii.*

19. A method as defined in claim 1, wherein the dyeing system comprises a dye selected from the group consisting of direct dyes, reactive dyes, vat dyes, sulfur dyes, azoic dyes, and combinations of any of the foregoing.

20. A method as defined in claim 1, wherein the dyeing system comprises: (a) one or more mono- or polycyclic aromatic or heteroaromatic compounds that act as dye precursors or enhancers and (b)(i) an enzyme exhibiting peroxidase activity and a hydrogen peroxide source or (ii) an enzyme exhibiting oxidase activity on the one or more mono- or polycyclic aromatic or heteroaromatic compounds.

21. A method as defined in claim 20, wherein said mono- or polycyclic aromatic or heteroaromatic compound is substituted with one or more functional groups, wherein each functional group is selected from the group consisting of $C_{1-6}$-alkoxy; $C_{1-6}$-alkyl; halogen; sulfo; sulfamino; nitro; azo; carboxy; amido; cyano; formyl; hydroxy; $C_{1-6}$-alkenyl; halocarbonyl; $C_{1-6}$-oxycarbonyl; carbamoyl; $C_{1-6}$-oxoalkyl; carbamidoyl; $C_{1-6}$-alkyl sulfanyl; sulfanyl; $C_{1-6}$-alkyl sulfornyl; phosphonato; phosphonyl; and amino.

22. A method as defined in claim 1, wherein the fibers comprise a textile.

23. A method as defined in claim 22, wherein said textile is cotton.

24. A method as defined in claim 1, wherein said contacting results in the removal of at least 50% of the pectin from the fibers.

25. A method as defined in claim 1, wherein said contacting results in a property selected from the group consisting of: (i) desired color shade and depth; (ii) satisfactory uniformity of dyeing; (iii) dyeing fastness of at least about 3.0 on a color gray scale; and (iv) combinations of any of the foregoing.

* * * * *